United States Patent [19]

Hamsher, Jr. et al.

[11] Patent Number: 4,655,515

[45] Date of Patent: Apr. 7, 1987

[54] DOUBLE ROW ELECTRICAL CONNECTOR

[75] Inventors: Wilbur A. Hamsher, Jr., New Cumberland; Joseph L. Lockard, Harrisburg, both of Pa.

[73] Assignee: AMP Incorporated, Harrisburg, Pa.

[21] Appl. No.: 754,784

[22] Filed: Jul. 12, 1985

[51] Int. Cl.[4] ..... H01R 4/66; H01R 9/11

[52] U.S. Cl. ..... 339/14 R; 339/176 M; 29/858

[58] Field of Search ..... 339/14 R, 14 P, 14 RP, 339/19, 176 M, 207 R, 206 R, 191 M, 192 R, 198 G, 198 H, 218 R, 218 M, 18 R, 18 B, 18 C, 18 P; 29/857, 858, 876, 883

[56] References Cited

U.S. PATENT DOCUMENTS

| | | | |
|---|---|---|---|
| 3,713,073 | 1/1973 | Narozny | 339/17 F |
| 4,260,209 | 4/1981 | Zell et al. | 339/14 R |
| 4,269,466 | 5/1981 | Huber | 339/107 |
| 4,456,317 | 6/1984 | McCleerey | 339/19 |
| 4,464,003 | 8/1984 | Goodman et al. | 339/14 R |
| 4,552,423 | 11/1985 | Swengel, Jr. | 339/19 |
| 4,579,404 | 4/1986 | Lockard | 339/176 MF |
| 4,602,830 | 7/1986 | Lockard | 339/14 R |
| 4,602,831 | 7/1986 | Lockard | 339/14 R |

FOREIGN PATENT DOCUMENTS 0112019 6/1984 European Pat. Off. .

*Primary Examiner*—Gil Weidenfeld
*Assistant Examiner*—Gary F. Paumen
*Attorney, Agent, or Firm*—Anton P. Ness

[57] ABSTRACT

An electrical connector has rows of contact locations which are signal locations and ground locations where ground locations in one row are programmable independently of ground locations in any other row. A housing member has secured thereto corresponding to each row of contact locations a terminal assembly having signal and ground terminals corresponding to the signal and ground locations in that row. Each terminal assembly has individual terminals on one side of a carrier corresponding to each contact location and a ground plane on the other side of the carrier. A method of making such an assembly is provided. Terminals at ground locations are welded to tab sections of the ground plane located only at ground locations, with such terminals becoming ground terminals. Terminals at signal locations are terminated to signal conductors of transmission cables, while ground conductors of the cables are terminated to the ground plane. A dielectric cover is molded over the terminals and ground plane secured to the carrier, and over end portions of the cables, thereby sealing the terminations, embedding and insulating the terminals rearwardly from the contact sections, and providing support and non-deforming strain relief to the cables. The terminal assemblies have the contact sections extending forwardly therefrom for insertion into respective housing passageways when the assemblies are secured to the housing such as by latches, and the assemblies may be secured to each other prior to securing to the housing such as by projections of each extending through slots in the other and cold-staked. Impedance problems are minimized by the electrical connector, providing for signal transmission of high reliability and uniformity.

29 Claims, 13 Drawing Figures

3
150
40
156
154
152
52
42
116
82
84
76
50
72
70
44
54
68
66
64
86
22
26
20
78
3
90
80
58
46
142
62
22
56
48
54
44
78
80
90

200
150
30
36
38
12
134
14
130
22
26
20
132
18
136
140
24
28
24
24
128
138

DOUBLE ROW ELECTRICAL CONNECTOR

CROSS-REFERENCE TO RELATED APPLICATIONS

This is a continuation-in-part application of U.S. patent application Ser. No. 536,017 filed Sept. 26, 1983, now abandoned and continued as Ser. No. 769,552 filed Aug. 26, 1985, now U.S. Pat. No. 4,602,831; which was a continuation-in-part application of U.S. patent application Ser. No. 442,472 filed Nov. 17, 1982, now abandoned, a continuation application of which was filed as U.S. patent application Ser. No. 670,662 filed Nov. 13, 1984, now abandoned.

FIELD OF THE INVENTION

The present invention relates to the field of electrical connectors and more particularly to the field of double row connectors for transmission cables.

BACKGROUND OF THE INVENTION

Double row receptacle connectors are known for flat transmission cable, which comprise a connector assembly for mating with a two-row pin array. Such connector assemblies route adjacent closely spaced signal conductors of the flat cable to terminals on alternating sides of the connector while routing the respective ground conductors to a ground bus contained in the connector.

U.S. Pat. No. 4,260,209 discloses such a connector for providing mass termination of a flat transmission cable, where the receptacle terminals for the signal conductors have slotted beam termination sections and are terminated to the conductors by insulation displacement. Similarly the ground conductors are secured in slotted beams of the ground bus. The receptacle terminals and ground bus are disposed along respective recesses of a housing, the conductors of the cable are terminated thereto, a cover is placed over the terminations, and a strain relief member is secured to the assembly. The connector provides for selective programming of ground terminals by connecting selected receptacle terminals to the ground bus instead of to signal conductors, by grounding bars or by sacrificed signal conductors.

U.S. Pat. No. 4,269,466 discloses another double row receptacle connector for flat transmission cable wherein the terminals are disposed in channels along opposing sides of a housing member and respective signal conductors are terminated by insulation displacement to slotted beam termination sections. Cover members are placed against the sides of the housing, locking to the housing at its forward end and to each other at the rearward end providing cable strain relief. A ground bus bar engages the ground conductors by a plurality of slotted beam termination sections. To selectively program the ground terminals of the connector, the ground bus bar can have selectively positioned termination sections to engage sacrificed signal conductors by insulation displacement which signal conductors then proceed forwardly to engage respective receptacle contacts which become ground terminals.

U.S. Pat. No. 4,602,831 assigned to the assignee hereof, discloses an electrical connector for individual transmission cables with minimized impedance discontinuities. The connector provides a row of plug contact sections extending forwardly from a dielectric contact-carrying member on one side of which are secured signal contacts terminated to signal conductors, and on the other side of which is secured a ground plane to which are terminated the ground conductors. An insulative cover is overmolded therearound which seals the terminations which are preferably laser welded, and also extends along the cables providing strain relief. Contact sections extend forwardly from the ground plane at selected locations aligned with the signal contact sections.

It is desirable to provide a double row receptacle connector with programmable grounds.

It is also desirable to provide such a connector for individual signal transmission cables.

It is still further desirable to provide such a connector for transmission of signals with high speed and high reliability by providing for minimized impedance discontinuities.

It is even further desirable to provide such a connector having a dielectric cover which seals the conductor/terminal connections and the adjacent lengths of insulated conductor cables, holds the terminals immobile, and spaces and provides strain relief for the cables without deforming them.

SUMMARY OF THE INVENTION

The present invention is a double row receptacle connector for high speed signal transmission cables for mating with a pin array and includes a premolded forward housing member having two rows of terminal-receiving passageways extending rearwardly from a mating face thereof. The forward housing member receives in the rearward end thereof two terminal assemblies each comprising a row of receptacle contact terminals. Terminals at those contact locations designated as signal locations are terminated to signal conductors of a row of respective transmission cables; terminals at ground locations are welded to a ground plane which is terminated to ground conductors of the cables; and the terminal subassemblies thus formed are then overmolded with a dielectric material. A contact section of each receptacle contact terminal extends forwardly of the overmolded covering to be received in a respective passageway of the forward housing member. The dielectric covering also seals the terminations of the terminals and conductors and seals along the adjacent insulated section of each cable to provide non-deforming strain relief, and when individual cables are used, to provide spacing between the cables. Ribbon cable may also be used with the present invention.

Prior to overmolding to form the terminal assemblies, the terminal subassemblies are completed in the following manner. The stripped ends of the signal conductors are routed along channels on one side of a dielectric contact-carrying member to which the terminals are affixed; and the signal conductors are then laser welded to respective signal terminals. The one or two stripped ground conductors associated with each respective signal conductor are routed along channels on the other side of the dielectric contact-carrying member to which a single ground plane is affixed; and the ground conductors are laser welded to the ground plane.

At pre-selected locations along the front end of the ground plane are electrical connections to terminals, forming ground terminals whose integral receptacle contact sections extend forwardly from the overmolded terminal assembly laterally aligned with the receptacle contact sections of the signal terminals and to be received in passageways of the forward housing member.

The locations of the ground contact sections in one of the terminal assemblies is independent of the locations of the ground contact sections in the other assembly.

The terminal assemblies can be secured to each other prior to assembly to the forward housing member by means of one or two projections from each assembly extending through slots in the other assembly between the conductors, whereafter the projections are cold-staked. The assemblies may have lateral latching projections at the forward ends which latchingly engage corresponding lateral latches of the forward housing member. Also, the receptacle contact sections may be retained in the terminal-receiving passageways such as by conventional rearwardly extending lances of the terminal, engaging forwardly facing stop surfaces on sidewalls of the passageways, and the forward terminal ends engaging rearwardly facing stop surfaces of the forward passageway ends. The assemblies can be removed if desired by a tool which has projections to extend inwardly from the mating surface to depress the terminal lances, and by the lateral housing latches being urged outwardly, whereafter the assemblies can be urged rearwardly.

Each terminal assembly of the present invention provides minimized impedance discontinuity for each row of its conductors and terminals through providing apertures in the ground plane opposite each signal contact, embedding and holding the terminals immobile within the subassembly, and providing nondeforming cable strain relief which also precisely spaces the respective cables when individual cables are used. The present invention also provides high integrity laser welding of conductors to contacts, and sealing and protecting of the terminations.

A plurality of double row connectors of the present invention can be placed side by side, each having a low profile to electrically mate with a multi-row pin array of a printed circuit board, or they can be placed end-to-end to mate a long double row of pins. The double row connector of the present invention may be used with a variety of transmission cables, such as ribbon cable, coaxial cable and two-lead cable.

DETAILED DESCRIPTION OF THE PREFERRED EMBODIMENT

Figure 1:
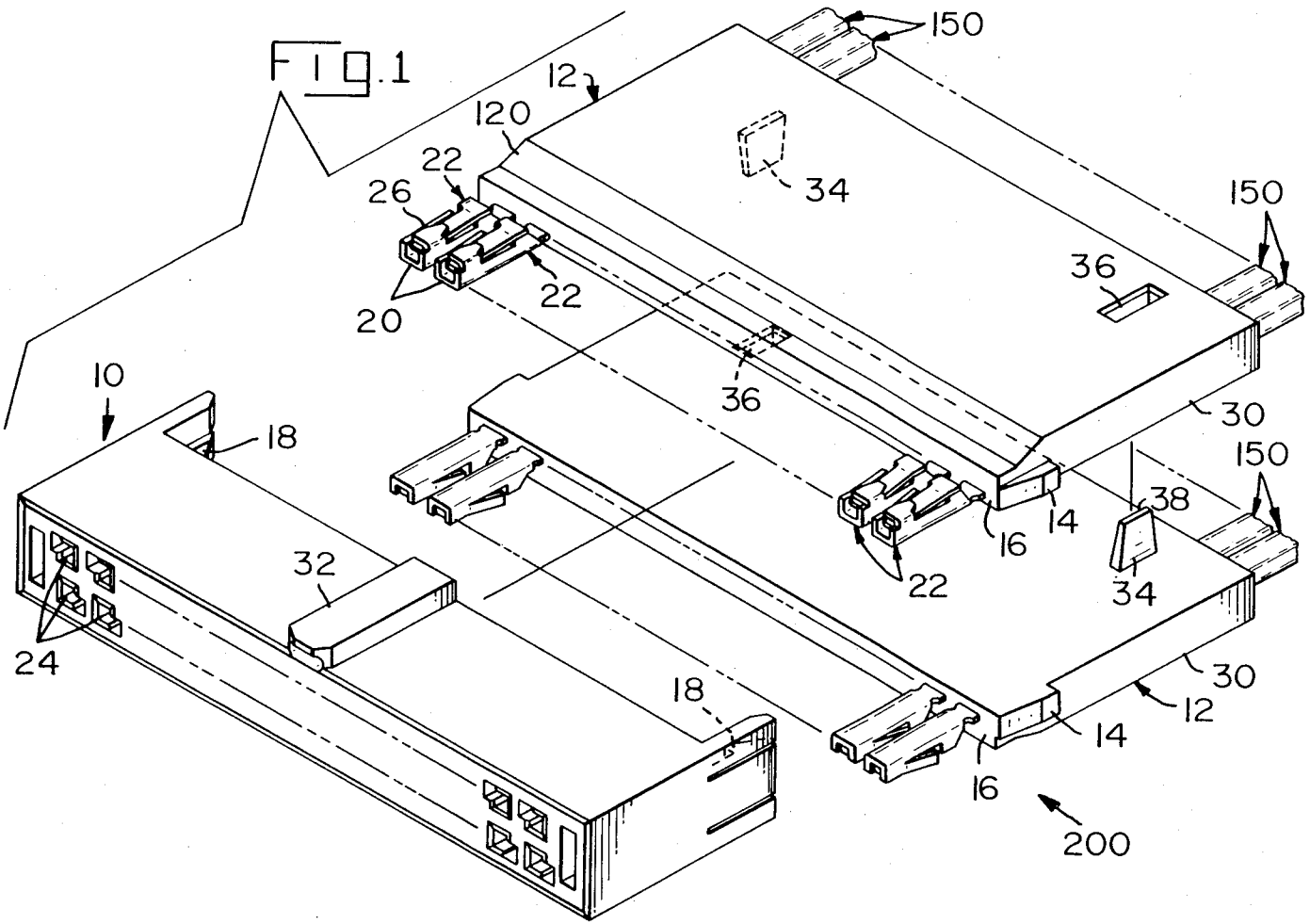
FIG. 1 is a perspective view of the connector with the two terminal assemblies exploded from the forward housing member.
Figure 10:
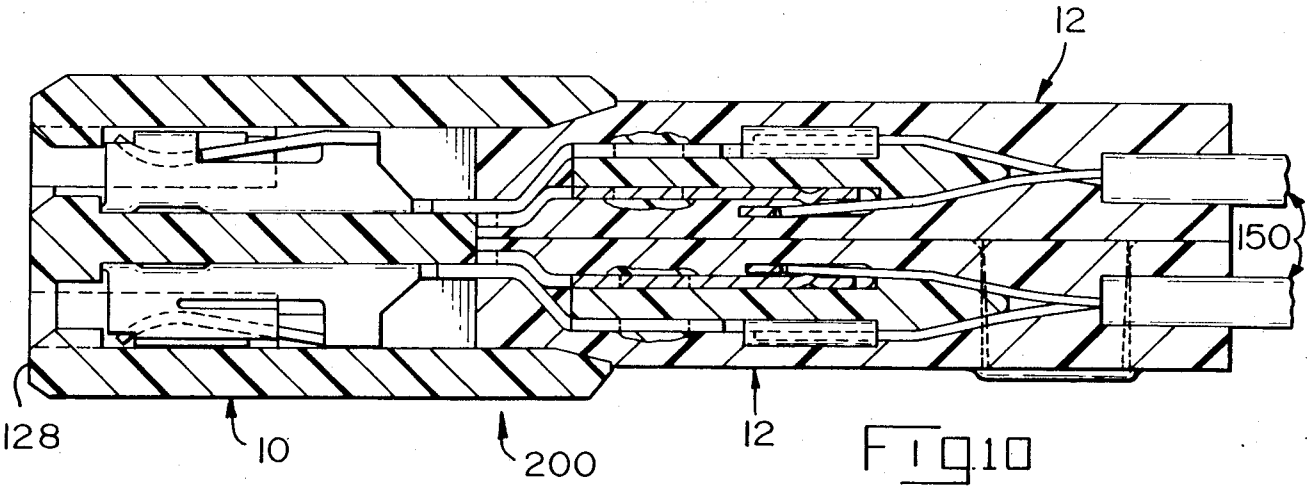
FIGS. 9 and 10 are longitudinal section views of a pair of terminal assemblies of FIG. 8 secured together for insertion into the forward housing member, and after insertion, respectively.
Figure 9:
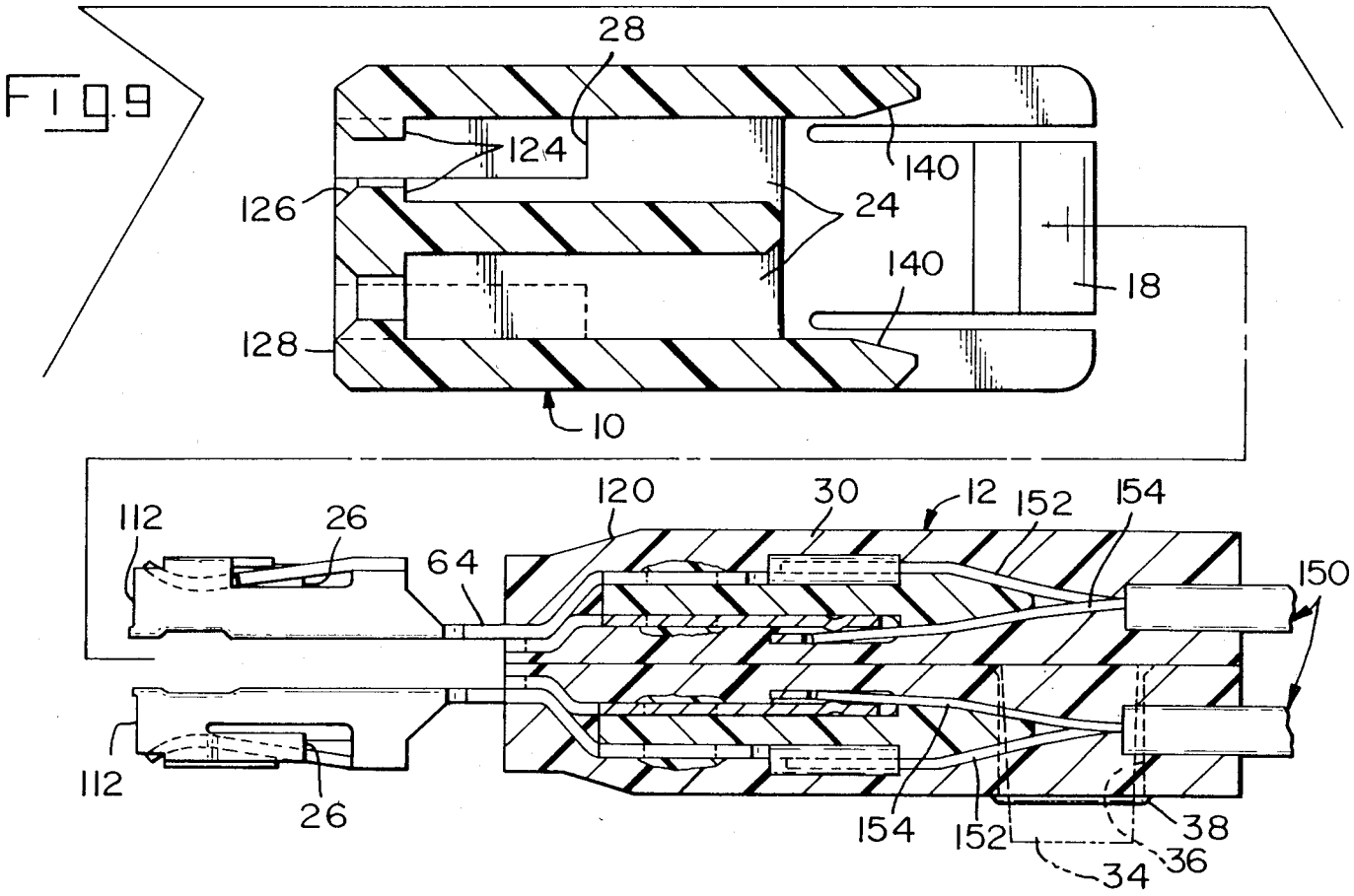

The connector assembly 200 of the present invention is shown in FIG. 1 and comprises a forward housing member 10 and a pair of terminal assemblies 12. Assemblies 12 are securable to housing 10 by latching projections 14 on each assembly 12 at the forward end 16 and laterally thereof engaged by latching arms 18 of housing 10. Box-type receptacle contact sections 20 of electrical contact terminals 22 extend in a row forwardly of forward end 16 of each assembly 12, to be received within terminal-receiving passageways 24 of housing 10 and preferably secured therewithin such as by locking lances 26 engaging stop surfaces 28 within passageways 24, as shown in FIGS. 9 and 10.

A row of electrical transmission cables 150 extends rearwardly from each assembly 12 with their signal and ground conductors terminated to terminals 22. Each terminal assembly 12 has a cover means 30 molded over a terminal subassembly comprising the terminals 22, the terminations of the signal and ground conductors thereto, and end portions of the transmission cables 150, all of which will be described with greater particularity below. Connector assembly 200 is matable with two rows of pin contacts of a pin array of a printed circuit board (not shown), and a keying feature 32 is shown on forward housing member 10 for proper mating with a shroud member around the pin array.

Figure 11A:
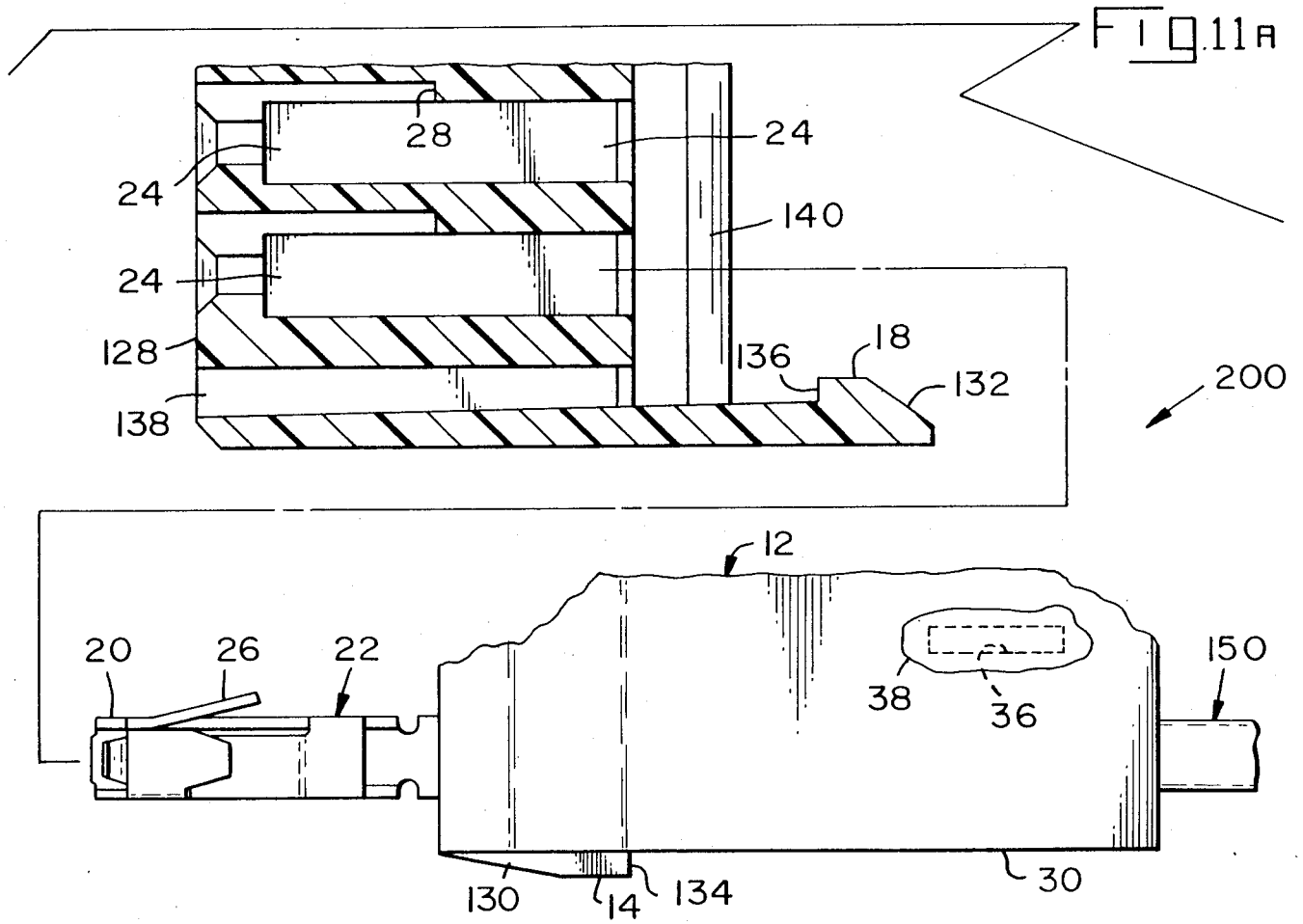
FIGS. 11A and 11B illustrate the latching of the terminal assemblies into the housing.
Figure 11B:
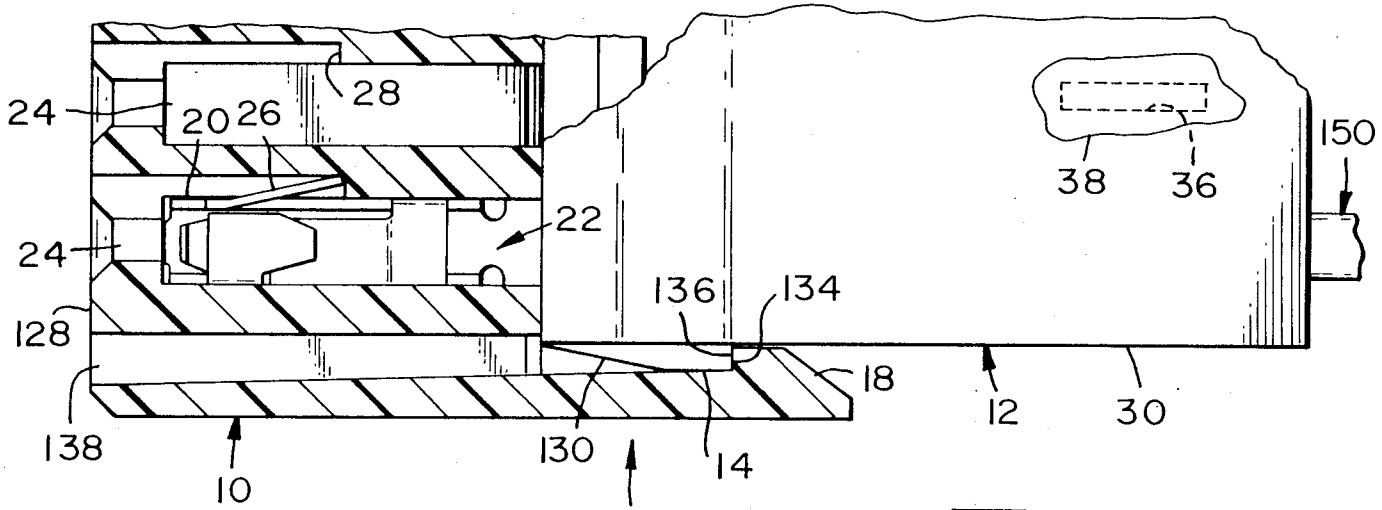

Terminal assemblies 12 are preferably first secured to each other prior to latching into housing 10, by means of one or more relatively vertical projections 34 on each assembly entering into axial slots 36 in the respective other assembly with free ends 38 extending beyond the remote surface thereof after which the projections' free ends 38 are cold-staked or deformably enlarged against the remote surface, as seen better in FIG. 11A.

Figure 2:
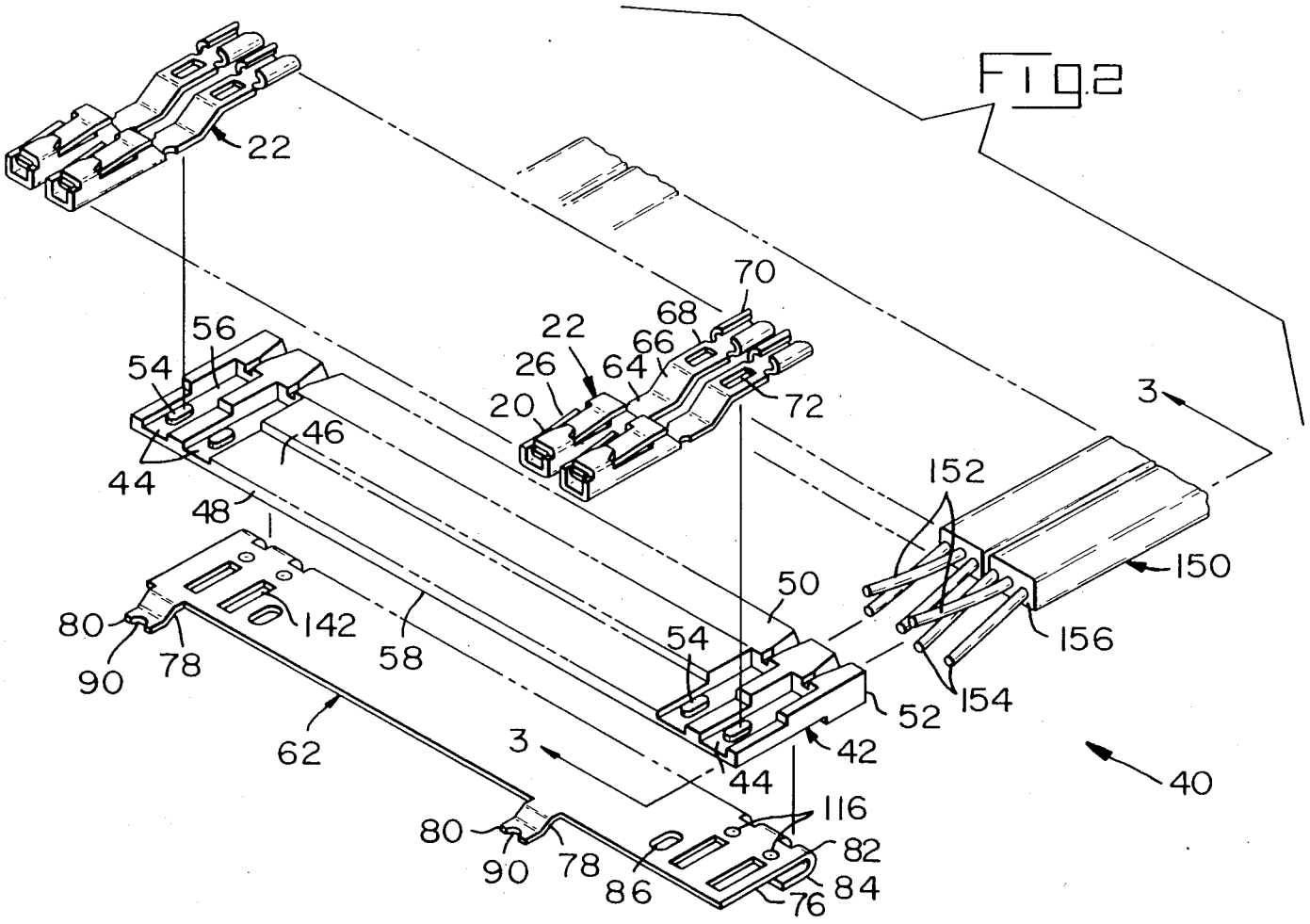
FIG. 2 is a perspective view of one of the terminal subassemblies showing the contact-carrying member, the signal terminals and the ground plane exploded therefrom and the cable ends exploded rearwardly therefrom, prior to termination and overmolding to become a terminal assembly.
Figure 3:
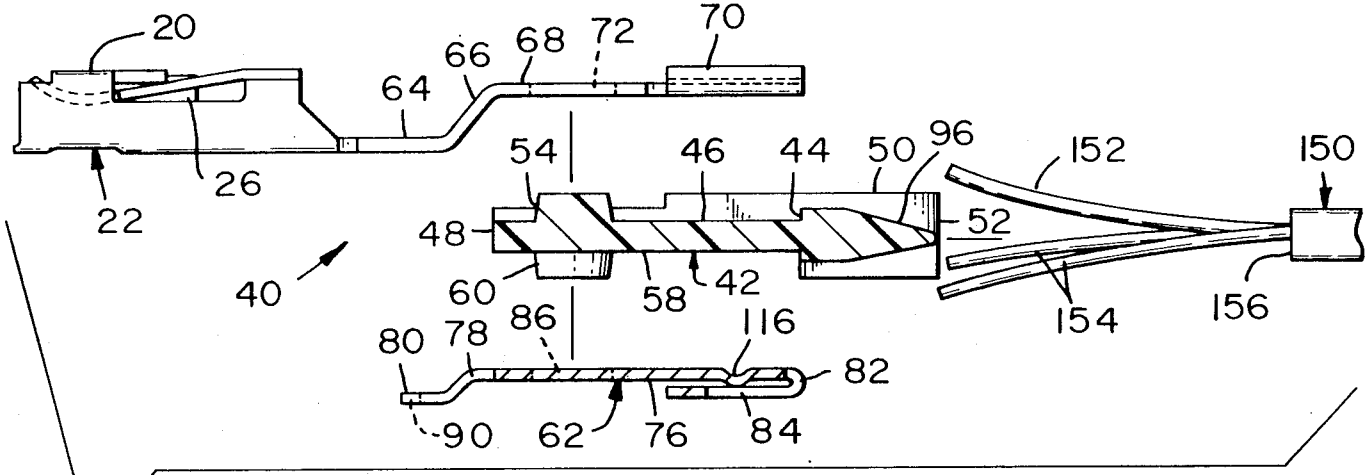
FIG. 3 is a longitudinal section view of the terminal subassembly taken through line 3—3 of FIG. 2.

FIG. 2 shows the terminal subassembly 40, from which a terminal assembly 12 is formed when subassembly 40 is overmolded by cover means 30. A dielectric contact-carrying member 42 is molded from a suitable material and has spaced channels 44 located on relatively top surface 46 and extending rearwardly from front end 48 to conductor-positioning section 50 at the rearward end 52 of contact-carrying member 42. Terminal-securing projections 54 extend upwardly from bottom channel surfaces 56 near front end 48. Relatively bottom surface 58 of contact-carrying member 42 is planar forwardly of conductor-positioning section 50, with securing projections 60 extending downwardly spaced across planar bottom surface 58 proximate front end 48; such a securing projection 60 is shown in FIG. 3. Ground plane 62 is to be secured to bottom surface 58 by projections 60 as will be explained later.

Figure 4:
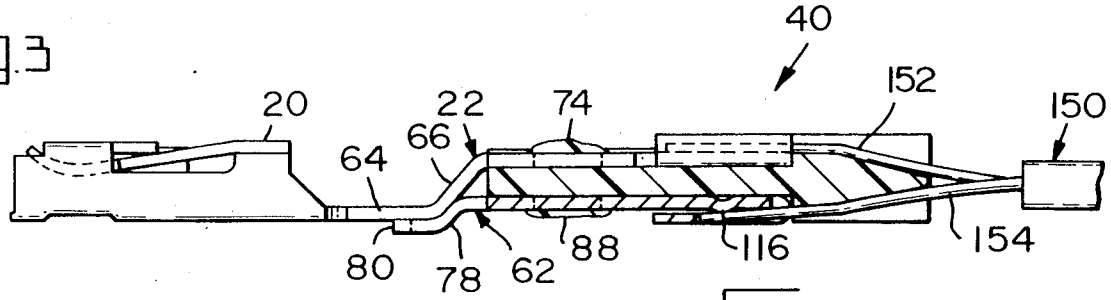
FIGS. 4 is a longitudinal section view of the terminal subassembly of FIG. 3 after terminals are secured and conductors connected thereto.

In FIGS. 2 to 4, terminals 22 are stamped and formed, preferably of Copper Alloy 725. Each terminal 22 has, proceeding rearwardly from contact section 20, intermediate section 64, relatively upwardly angled section 66, and securing section 68, with conductor-connecting section 70 at the rearward end thereof. Securing section 68 and conductor-connecting section 70 of each terminal 22 is disposed in a respective channel 44. Securing section 68 has a hole 72 therein corresponding to securing projection 54 in channel 44 through which projection 54 extends. Projection 54 is cold-staked (or heat-staked, as desired) to enlarge the end of projection 54 over securing section 68 and thus secure terminal 22 to top surface 46 of contact-carrying member 42 by enlarged end 74. Thus angled section 66, intermediate section 64 and contact section 20 of each receptacle terminal 22 extend forwardly of front end 48 along the longitudinal axis of terminal 22 and channel 44 while conductor-connecting section 60 is disposed proximate and forwardly of conductor-positioning section 50 of contact-carrying member 42.

In FIGS. 2 to 4, ground plane 62 has an elongated planar section 76 from which tab sections 78 extend forwardly at a slight angle downwardly with short tab ends 80 extending horizontally forwardly therefrom. Tab sections 78 are formed at preselected locations as will be explained later. Along the rearward end of ground plane 62 is a conductor-connecting section 84 preferably comprising a bent-back portion of the metal blank from which ground plane 62 is stamped and formed, the rearward end being a bight section 82. Proximate the forward end of ground plane 62 and thereacross are disposed a plurality of holes 86 corresponding to securing projections 60 on bottom surface 58 of contact-carrying member 42. Ground plane 62 is secured onto bottom surface 58 by securing projections 60 extending through holes 86 and their ends 88 being enlarged by cold-staking (or heat-staking, as desired) to deform them against the bottom of ground plane 62. Tab sections 78 extend forwardly of front end 48 of contact-carrying member 42 in subassembly 40. It is preferable to have apertures 142 which will be opposed from securing sections 68 of the plurality of terminals 22 after forming terminal subassembly 40; such apertures 142 assist in impedance matching as disclosed in U.S. Pat. No. 4,602,831 by increasing the insulative distance between signal terminals and ground plane in the finished terminal assembly.

Figure 5:
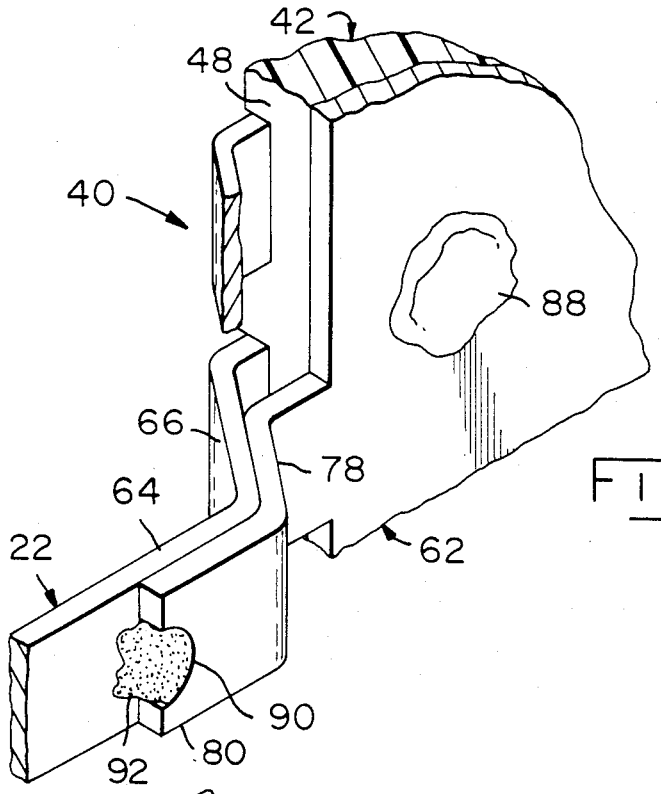
FIG. 5 is an enlarged perspective view from below of a terminal welded to a ground plane tab.

Connector assembly 200 can have ground contacts at any desired location in either row, and the ground locations in one row are independent of the ground as signal locations in the other row, thus providing for independently programmable grounds. Referring to FIGS. 2 and 5, tab sections 78 of ground plane 62 are integral therewith and positioned at those selected locations forwardly of which a ground is desired in the connector assembly 200. Preferably such positioning is accomplished by forming tab sections at all locations and striking off those not wanted for grounds. Rearwardly of those ground locations no signal conductor will be located which is intended to be used for signal transmission. In a ribbon cable, for example, although a signal conductor will be disposed at those ground locations it would not be used for signal transmission and, hence, is sacrificed. Where individual electrical cables are used such as in the example shown, no cable is located at such ground locations. However, a terminal 22 will be located at such ground locations secured to top surface 46 of contact-carrying member 42 and its intermediate section 64 welded to a tab end 80, as shown in FIG. 5. Tab end 80 preferably has a semicircular recess 90 to enhance the strength of the weld 92. Thus such terminal 22 will provide the ground contact section to electrically connect ground plane 62 to respective ground pins of the pin array. In FIG. 4, terminal 22 is not welded nor in engagement with ground plane 62 at tab section 78 or tab 80 but is laterally spaced therefrom.

Cables 150 as shown herein are tri-lead transmission cables having a signal conductor 152, two ground conductors 154 spaced laterally therefrom, and outer insulative jacket 156 having a rectangular cross section. Other types of transmission cable are usable with the present invention, such as round individual cables, coaxial cables having one ground conductor, tri-lead cables having an inner jacket around the signal conductor and a foil shield within the outer jacket and around the ground and insulated signal conductors, and also ribbon cable having a plurality of signal and associated ground conductors. Cables 150 are prepared for termination by removing the insulative outer jacket 156 from end portions thereof, exposing the signal and ground conductors.

Figure 6A:
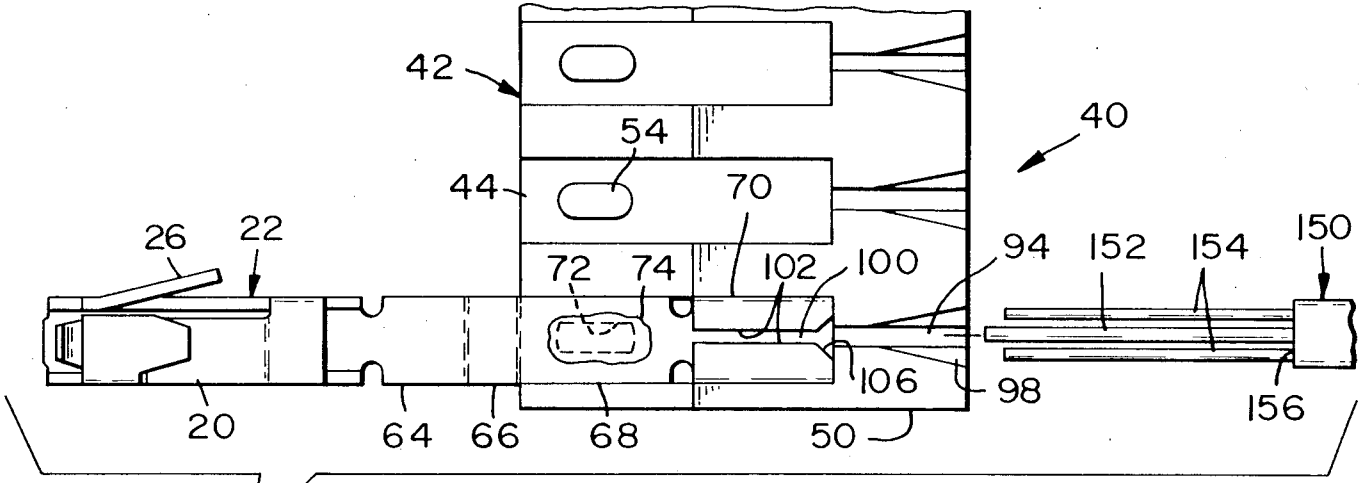
FIGS. 6A and 6B are top partial views of a signal conductor before and after welding to a signal terminal in a terminal subassembly.
Figure 6B:
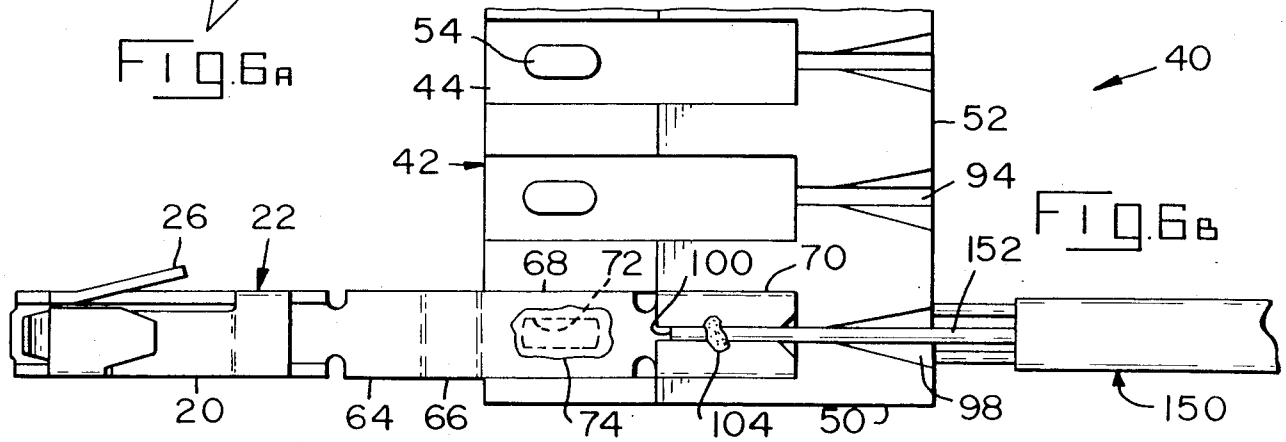

As seen in FIGS. 4 and 6B, cables 150 are disposed in the plane of contact-carrying member 42, and signal conductors 152 are diverted relatively upward and ground conductors 154 relatively downward. Signal conductors 152 are disposed along respective signal channels 94 of conductor-positioning section 50 and forwardly proximate upper surface 46 of contact-carrying member 42 to and along respective conductor-connecting sections 70 of signal terminals 22 for termination thereto. Signal channels 94 have an upwardly sloping bottom surface 96 proceeding forwardly from rearward end 52. Lead-in 98 has chamfered corners to facilitate placement of a respective signal conductor 152 into and along channel 94, as disclosed in U.S. Pat. No. 4,579,404 and incorporated herein by reference.

Conductor-connecting section 70 of each signal terminal 22 preferably includes a narrow conductor-receiving slot 100 as seen in FIG. 6A. Slot 100 preferably is narrower than the diameter of signal conductor 152 such that signal conductor 152 may be press fit thereinto and held in interference fit thereby prior to laser welding of the conductors to the terminal, as disclosed in U.S. patent application Ser. No. 754,785 filed July 12, 1985. Slot 100 is preferably formed by opposing spaced end surfaces 102 of stamped tabs extending laterally from sides of the terminal blank whose free ends are bent around toward each other proximate the top surface of the blank during forming of the terminal. A length of signal conductor 152 is then held in interference fit proximate the top of slot 100 by slight spring action by and between end surfaces 102 and is then welded to conductor-connecting section 70 by weld 104, as seen in FIG. 6B. The top edges of slot 100 preferably are smoothed to facilitate receipt of the conductor thereinto, and a tapered lead-in 106 to slot 100 is also preferred.

Figure 7:
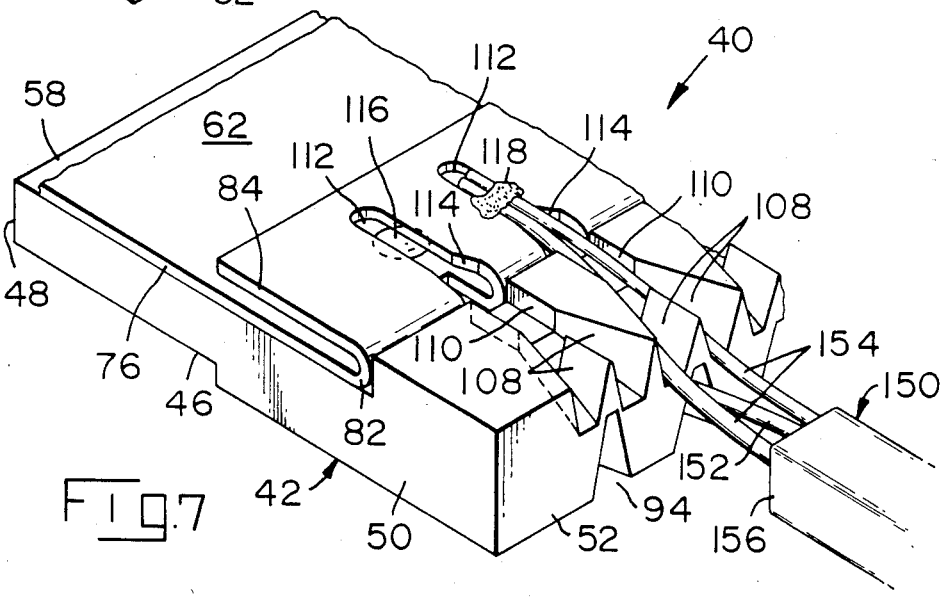
FIG. 7 is an enlarged perspective view of a pair of ground conductors routed along merging channels in the carrier and terminated to the ground plane at a single weld, in a terminal subassembly.

Similarly and preferably simultaneously the pair of ground conductors 154 are diverted relatively downward and forwardly along a pair of respective ground channel portions 108 extending forwardly from rearward end 52 of contact-carrying member 42, as shown in FIG. 7. Each pair of ground channel portions 108 converge into a single wider main ground channel 110 in conductor-positioning section 50 along bottom surface 58. Each pair of now-adjacent ground conductors 154 is disposed side by side forwardly along main ground channel 110 to and along a respective portion of conductor-connecting section 84 of ground plane 62 for termination thereto. As described in U.S. Pat. Nos. 4,579,404 and 4,602,831, conductor-connecting section 84 of ground plane 62 preferably comprises a plurality of slots 112 which are in communication with respective openings 114 in rearward bight section 82 which neck down as they merge with slots 112. The width of each slot 112 is preferably narrower than twice the diameter of a ground conductor 154 such that the pair of ground conductors 154 may be press fit thereinto and held in interference fit thereby prior to laser welding of the pair of ground conductors to the ground plane. It is preferred to have formed a dimple-like projection 116 extending from planar section 76 of ground plane 62 towards and to each slot 112 centrally thereof to facilitate precisely locating the pair of adjacent ground conductors 154 within the slot adjacent the outer surface of conductor-connecting section 84 for welding to ground plane 62 by weld 118. It is preferable that the top edges of slots 112 are smoothed to facilitate receipt of the pairs of conductors thereinto. Placement of two ground conductors in a single slot 112 halves the number of such slots needed, and the number of separate weld joints to be made.

The signal conductors and ground conductors are preferably laser welded to the respective conductor-receiving sections of the terminals and ground plane. Laser welding is generally known and is discussed extensively in *Materials Processing Theory and Practices, Volume* 3: *Laser Materials Processing,* (edited by M. Bass, North-Holland Publishing Company, 1983) especially Chapter 3, "Laser Welding," J. Mazumder, pp. 113–200. In particular, laser welding in electronics is described in *Electronics,* Sept. 22, 1981 in an article by Henderson on pages 149–154 entitled "Dual Lasers Speed Termination of Flexible Printed Wiring."

Figure 8:
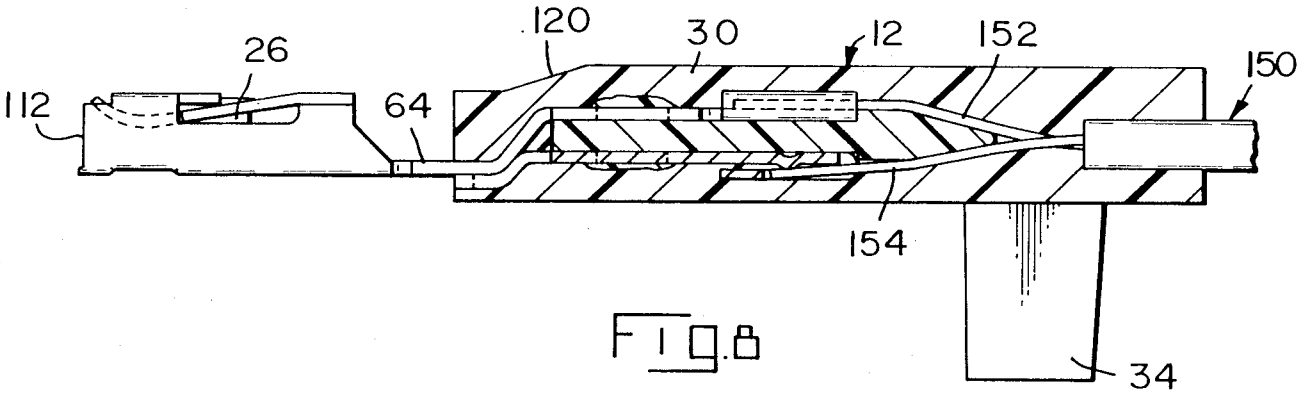
FIG. 8 is a longitudinal section view of the overmolded terminal assembly.

Referring now to FIG. 8, terminal subassembly 40 is placed in a mold cavity with contact sections 20 and cables 150 extending outwardly therefrom. Moldable dielectric material is injected into the mold cavity and dielectric cover means 30 is molded over contact-carrying member 42. Cover means 30 sealingly secures and protects end portions of cables 150, signal conductors 152 and their terminations to conductor-connecting sections 70 of terminals 22 at welds 104, ground conductors 154 and their terminations to conductor-connecting section 84 of ground plane 62. Cover means 30 also sealingly secures and protects the entirety of ground plane 62 and welds 92 of tab ends 80 with those terminals 22 selected to be grounds, and the entirety of terminals 22 beginning just rearwardly from contact sections 20 centrally of intermediate sections 64. By sealing and embedding end portions of the transmission cables 150, cover means 30 supports them and provides strain relief therefor. Also formed during the overmolding process are downwardly extending projections 34 and corresponding slots 36, and lateral latching projections 14. It may optionally be desirable to form transverse bars for second cable strain relief as described in U.S. patent application Ser. No. 754,785 joined by web sections to cover means 30, or as in U.S. Pat. No. 4,602,831. It is preferred to form a downwardly tapered surface 120 on cover means 30 proximate forward end 16 of terminal assembly 12 extending laterally thereacross.

FIGS. 9 to 11B demonstrate the final steps in assembling connector assembly 200. A pair of terminal assemblies 12 are secured together by projections 34 of each assembly 12 extending through corresponding slots 36 of the other assembly and their free ends 38 being enlarged such as be cold-staking. The pair of assemblies 12 is moved forwardly into housing member 10, with contact sections 20 of terminals 22 entering corresponding terminal-receiving passageways 24 wherein the contact sections are individually secured such as by locking lances 26 each extending rearwardly to engage a forwardly facing stop surface 28 on a corresponding wall of the respective passageway 24. Forward end 112 of each contact section 20 is engageable with rearwardly facing stop surfaces 124 proximate forward end 126 of passageway 24 which communicates with mating face 128 of housing member 10. Tapered surface 130 of lateral latch 14 facilitates riding over corresponding housing latch arm 18 having beveled surface 132 and urging it outwardly. Latching surface 134 of lateral latch 14 latches behind corresponding latching surface 136 of latch arm 18. Cavities 138 extending rearwardly from mating surface 128 of housing 10, facilitate molding of latching surface 136. Tapered surfaces 120 on the upper and lower surfaces of the secured pair of assemblies 12 engages corresponding tapered housing surfaces 140 to facilitate insertion and provide a slight interference fit of assemblies 12 in housing member 10. The pair of terminal assemblies 12 could be removed, if desired, from housing 10 by unlatching all locking lances 26, and by unlatching latch arms 18, and pulling assemblies 12 rearwardly.

It is possible to provide a connector having more than two rows of contacts with independently programmable grounds, by stacking together a like plurality of single-row terminal assemblies with contact sections extending forwardly into a forward housing member to be mated with mating terminals. It is also possible to provide a plug connector where the forward housing number is a shroud and the contact sections are plug sections as disclosed in U.S. Pat. No. 4,602,831, or are pin contact sections. Further, it is possible to stack together a plurality of connectors of the present invention to mate with more than two rows of a pin array, because of the low profile of the present connector, by not providing a keying feature 32 thereon.

Other variations may be devised which are within the scope of the claims and the spirit of the invention.

What is claimed is:

1. A multi-row electrical connector for signal conductor means and ground conductor means of electrical cable means for use in transmitting electrical signals with high reliability and uniformity, said connector having at least two rows of contact locations comprising signal locations and ground locations in each row which are independently programmable from row to row, comprising:

a plurality of single-row terminal assemblies secured together, each said terminal assembly having at least one ground contact section and a plurality of signal contact sections disposed at preselected locations along a forward end of said terminal assembly and in a single row, said preselected locations corresponding to respective said desired ground and signal locations of said associated row, wherein each said terminal assembly comprises:

(a) a dielectric contact-carrying member;

(b) a plurality of individual terminal means secured to one side of said dielectric contact-carrying member at all contact locations therealong and including a contact section means extending forwardly of said contact-carrying member;

(c) a ground plane means secured to the other side of said contact-carrying member and having at least one tab section means extending forwardly of said contact-carrying member at said at least one preselected ground location, each said at least one tab section means affixed and electrically connected to a respective one of said individual terminal means rearwardly of the contact section means thereof transforming each said respective ones of said individual terminal means into a ground terminal means;

(d) end portions of electrical cable means having signal conductor means and having ground conductor means associated with respective said signal conductor means, said signal conductor means aligned with respective said desired signal locations;

(e) terminations of said ground conductor means of said electrical cable means to said ground plane means;

(f) terminations of said signal conductor means of said electrical cable means to respective others of said individual terminal means transforming said others into signal terminal means; and (g) dielectric cover means secured sealingly over said signal and ground terminations and around said individual terminal means and ground plane means rearwardly from said contact sections and around end portions of said electrical cable means, whereby said ground terminals are locatable in any respective positions along a row of said contact locations of said connector independently of ground locations of any other row thereof in a manner minimizing impedance discontinuity.

2. A multi-row electrical connector as set forth in claim 1 wherein each said tab section means is welded to a respective said individual terminal means.

3. A multi-row electrical connector as set forth in claim 1 wherein said contact section means are receptacle contact sections.

4. A multi-row electrical connector as set forth in claim 3 wherein said plurality of terminal assemblies are securable to a forward housing member having terminal-receiving passageways within which said receptacle contact sections are disposed to be electrically mated to corresponding pin contacts insertable thereinto.

5. A multi-row electrical connector as set forth in claim 4 wherein said plurality of terminal assemblies are securable to said forward housing member by means of latching projections extending laterally from said terminal assemblies being latchingly engaged by corresponding latching arms of said forward housing member.

6. A multi-row electrical connector as set forth in claim 5 wherein pairs of said terminal assemblies are first securable together by securing means comprising at least one projection extending from a side surface of said dielectric cover means of at least one said terminal assembly toward the other said terminal assembly of said pair and received into and through a respective slot in said other terminal assembly and extending to a remote side thereof, whereafter the end of said at least one projection is deformably enlarged against the surface of said remote side of said other terminal assembly.

7. A multi-row electrical connector as set forth in claim 1 wherein each said individual terminal means includes a rearward conductor-connecting section means, a securing section means forwardly thereof and at least an intermediate section means forwardly of said securing section means and rearwardly of said contact section means, said intermediate section means extending forwardly of said contact-carrying member such that the intermediate section means of ground ones of said individual terminal means are adjacent respective associated tab section means of said ground plane means to be affixed thereto.

8. A multi-row electrical connector as set forth in claim 7 wherein each said individual terminal means further includes an angled section means between said securing section means and said intermediate section means, said angled section means extending forwardly of said contact-carrying member and toward the plane of said ground plane means.

9. A multi-row electrical connector as set forth in claim 7 wherein each said conductor-connecting section means includes a slot capable of receiving therein a respective signal conductor means in interference fit to be terminated thereto.

10. A multi-row electrical connector as set forth in claim 9 wherein each said signal conductor means is disposed along a signal channel of said contact-carrying member rearwardly of a respective said conductor-receiving slot of a said signal terminal, along and within said slot and laser welded thereto.

11. A multi-row electrical connector as set forth in claim 7 wherein each said securing section means includes a hole therein to receive therethrough a corresponding securing projection of said contact-carrying member whereafter the end of said securing projection is deformably enlarged to secure said terminal means to said contact-carrying member.

12. A multi-row electrical connector as set forth in claim 11 wherein each said individual terminal means is disposed along a channel of said contact-carrying member.

13. A multi-row electrical connector as set forth in claim 1 wherein said ground plane means includes a conductor-connecting section means at a rearward end thereof and a planar elongated securing section means forwardly therefrom, said tab section means extending forwardly from said securing section means.

14. A multi-row electrical connector as set forth in claim 13 wherein said securing section means includes a plurality of holes to receive therethrough corresponding securing projections of said contact-carrying member whereafter the ends of said securing projections are deformably enlarged to secure said ground plane means to said contact-carrying member.

15. A multi-row electrical connector as set forth in claim 13 wherein said conductor-connecting section means comprises a bent back section which includes a plurality of slots each capable of receiving therein respective ground conductor means in interference fit to be terminated thereto.

16. A multi-row electrical connector as set forth in claim 15 wherein each said ground conductor means is disposed along a ground channel means of said contact-carrying member rearwardly of a respective said conductor-receiving slot, along and within said slot and laser welded thereto.

17. A multi-row electrical connector as set forth in claim 16 wherein each said ground conductor means associated with each said signal conductor means comprises a pair of ground conductor wires, said ground channel means converges proximate said conductor-receiving slot of said ground plane means, said pair of ground conductor wires converges therein, said slot has a width less than twice the diameter of one said ground conductor wire, and said pair of wires is disposed sideby-side within said slot in interference bit and laser welded thereto.

18. A multi-row electrical connector as set forth in claim 17 wherein said ground plane means includes a plurality of projections proximate the rearward end thereof, each extending from said securing section means towards and to the bottom of a respective said conductor-receiving slot to support said pair of ground conductor wires, locating them proximate the top of said slot.

19. A multi-row electrical connector as set forth in claim 13 wherein said securing section means has axially extending apertures disposed opposed from said individual terminal means secured on said one side of said contact-carrying member, increasing the insulative distance between each said individual terminal means and that portion of said ground plane means coextending therewith and opposed therefrom along said other side of said contact-carrying member.

20. A multi-row electrical connector as set forth in claim 1 wherein each said at least one tab section means at a preselected ground location has an end section adjacent a respective individual terminal means at said preselected ground location rearwardly from said contact section means thereof, said end section having a semicircular recess therein to facilitate forming a strong weld joint thereat joining said tab end section and said individual terminal means.

21. A multi-row electrical connector as set forth in claim 1 wherein said ground plane means is stamped from a metal blank with tab section means at all contact locations, and with those tab section means at desired signal locations being removed therefrom prior to securing said ground plane means to said contact-carrying member.

22. A multi-row electrical connector as set forth in claim 1 wherein a pair of said terminal assemblies are secured together by securing means comprising at least one projection extending from a side surface of said dielectric cover means of at least one said terminal assembly toward the other said terminal assembly and received into and through a respective slot in said other terminal assembly extending to a remote side thereof, whereafter the end of said at least one projection is deformably enlarged against the surface of said remote side of said other terminal assembly.

23. An electrical connector assembly for signal conductor means and ground conductor means of electrical cable means for use in transmitting electrical signals with high reliability and uniformity, said connector having at least two rows of contact locations comprising signal locations and ground locations in each row which are independently programmable from row to row, comprising:

a forward housing means having a mating face and rows of terminal-receiving passageways at desired contact locations communicating with and extending rearwardly from said mating face, and a plurality of terminal assemblies secured to said forward housing means, ones thereof associated with respective said rows of passageways, each terminal assembly including:

(a) a dielectric contact-carrying means substantially disposed in a plane;

(b) a plurality of individual terminal means secured to one side of said contact-carrying means spaced laterally thereacross corresponding to said contact locations, ones of said individual terminal means at said signal locations being signal terminal means and others at said ground locations being ground terminal means, each said individual terminal means including a contact section means extending forwardly of said contact-carrying means, a conductor-connecting section means disposed along said one side of said contact-carrying means proximate a rearward end thereof capable of receiving and being terminated to respective signal conductor means of electrical cable means, a securing section means between said contact section means and said conductor-connecting section means, and at least an intermediate section forwardly of said securing section means;

(c) ground plane means secured to the other side of said contact-carrying means including a conductor-connecting section means disposed along said other side of said contact-carrying means proximate said rearward end thereof and capable of receiving and being terminated to a plurality of ground conductor means of said electrical cable means, said ground plane means further having a securing section means forwardly of said conductor-connecting section means and disposed along said other side of said contact-carrying means and further having at least one tab section means extending forwardly from said securing section means and forwardly of said contact-carrying means at a preselected ground location, said at least one tab section means being adjacent and joined to a portion of said intermediate section means of a said individual terminal means at said preselected ground location, forming a said ground terminal means;

(d) electrical cable means substantially disposed in said plane of said contact-carrying means rearwardly therefrom and having signal conductor means and ground conductor means, said signal conductor means located rearwardly from said signal locations, a plurality of stripped end portions of signal conductors and ground conductors extending forwardly from said electrical cable means with at least one said ground conductor associated with each said signal conductor, said stripped end portions extend along a rearward portion of said contact-carrying means with said signal conductor end portions electrically connected to respective said conductor-connecting section means of said signal terminals and said ground conductor end portions electrically connected to said conductor-connecting section means of said ground plane; and (e) dielectric cover means secured sealingly onto and around said contact-carrying means, said electrical connections, said signal and ground end portions, insulated end portions of said electrical cable means, and said individual terminal means and said ground plane means rearwardly from said contact section means thereof, embedding the individual terminals, sealing the terminations and providing support and non-deforming strain relief for said electrical cable means whereby with said contact section means of said terminal assemblies disposed in respective said housing passageways, ground terminals are locatable in any position along a row of said contact locations of said connector independently of ground terminal locations in any other row thereof in a manner minimizing impedance discontinuity.

24. A method of making a multi-row electrical connector having at least two rows of contact locations comprising signal locations and ground locations in each row which are independently programmable from row to row, comprising the steps of:

selecting signal locations and ground locations in each row;

forming a ground plane associated with each said row having tab sections at each ground location extending forwardly from an elongated planar section thereof and having a conductor-connecting section rearwardly of said planar section;

securing said ground plane to one side of a respective dielectric contact-carrying member such that said tab sections extend forwardly thereof;

securing to the other side of said contact-carrying member a plurality of individual terminals at all contact locations of said row, each said terminal including a contact section extending forwardly of said contact-carrying member, an intermediate section rearwardly from said contact section, and a securing section and a conductor-connecting section along said other side of said contact-carrying member, said intermediate section of each said terminal at a said ground location being adjacent a respective tab section of said ground plane;

affixing and electrically connecting each said tab section to an associated said terminal forming a ground terminal;

terminating signal conductors of electrical cable means to respective conductor-connecting sections of said individual terminals at signal locations, forming signal terminals;

terminating the ground conductor means associated with said signal conductors of said electrical cable means to said conductor-connecting section of said ground plane;

sealingly securing a dielectric cover means over said terminations, around end portions of said electrical cable means, and around said individual terminals and said ground plane rearwardly from said contact sections, forming a single-row terminal assembly for each said row of contact locations; and securing together said single-row terminal assemblies for said at least two rows.

25. A method as set forth in claim 24 wherein said step of securing said terminal assemblies together comprises forming at least one projection on one side of a said terminal assembly extending towards an another said terminal assembly and forming a corresponding at least one slot in said other terminal assembly, extending said at least one projection into and through said corresponding at least one slot with a free end thereof extending beyond a remote surface of said other terminal assembly, and deformably enlarging said free end against said remote surface.

26. A method as set forth in claim 25 wherein said secured-together terminal assemblies are then secured to a forward housing member.

27. A method as set forth in claim 24 further comprising the additional step of securing said terminal assemblies to a forward housing member.

28. A method as set forth in claim 24 wherein said forming of said ground plane comprises forming tab sections at all contact locations and removing those tab sections at signal locations.

29. A method as set forth in claim 24 wherein said affixing step comprises welding each said tab section to said associated terminal.

* * * * *